US007696949B2

(12) United States Patent
Shin

(10) Patent No.: US 7,696,949 B2
(45) Date of Patent: Apr. 13, 2010

(54) RECEIVING ANTENNA

(76) Inventor: Jeong Hyeon Shin, 315-11 Hwajeong-Dong, Danwon-Gu, Ansan, Gyeonggi-Do 425-430 (KR)

( * ) Notice: Subject to any disclaimer, the term of this patent is extended or adjusted under 35 U.S.C. 154(b) by 195 days.

(21) Appl. No.: 12/051,916

(22) Filed: Mar. 20, 2008

(65) Prior Publication Data

US 2008/0231539 A1 Sep. 25, 2008

(30) Foreign Application Priority Data

Mar. 22, 2007 (KR) ..... 10-2007-0028199

(51) Int. Cl.
*H01Q 3/02* (2006.01)

(52) U.S. Cl. ..... 343/882; 343/880; 343/757

(58) Field of Classification Search ..... 343/878, 343/880, 882, 757, 765
See application file for complete search history.

(56) References Cited

U.S. PATENT DOCUMENTS 3,739,387 A * 6/1973 Budrow et al. ..... 343/714
6,466,181 B1 * 10/2002 Ho et al. ..... 343/882
6,483,476 B2 * 11/2002 Cox ..... 343/815
7,205,953 B2 * 4/2007 Knadle et al. ..... 343/792.5
7,286,097 B1 * 10/2007 Van Buren et al. ..... 343/811
2003/0090423 A1 * 5/2003 Horii ..... 343/727

* cited by examiner

*Primary Examiner*—Hoang V Nguyen
(74) *Attorney, Agent, or Firm*—Dykema Gossett PLLC

(57) ABSTRACT

The invention provides a sky wave receiving antenna which includes a receiving element having a radiator and a plurality of directors arranged in parallel on a horizontal support boom with a constant interval in a alternatively crossed direction, a base and a vertical direction adjustor rotationally connected at its one end to the base with a use of a first joint. The receiving antenna further includes a second joint connected to the other end of the vertical direction adjustor and connected to the receiving element so as to obtain a horizontal direction adjustment of the receiving element. The receiving antenna of the invention allows the adjustment of the receiving element to be made in both vertical and horizontal directions in order to enhance the receive directivity.

5 Claims, 5 Drawing Sheets

RECEIVING ANTENNA

FIELD OF THE INVENTION

This invention relates to a receiving antenna for sky waves, and in particular to a receiving antenna which enhances the receive directivity by adjusting angles in both horizontal and vertical directions with two joints.

BACKGROUND OF THE INVENTION

There has been provided various types of sky wave receiving antennas such as dipole, pole, loop, parabola, Yagi and log periodic antennas, among which the log periodic antenna is much broadly used in the receiving antenna field. The log periodic antenna includes a horizontal support rod, a radiator placed across the support rod and a plurality of constantly spaced directors placed in parallel, and is horizontally installed to receive sky waves with the aid of structures like pipes or walls through clamping devices.

For the receiving antenna, it is necessarily required to adjust a receive angle of the antenna for receiving signals with directivity from a particular direction. The adjustment structure for adjusting the receive angle of the receiving antenna is accomplished with the use of the clamping devices by turning in a right or left direction with keeping the receiving antenna stable in its horizontal direction.

The angular adjustment of the receiving antenna for reception of signals only in a horizontal direction results in low reception ratio due to failure of the adjustment of the receiving antenna in the scanning direction for signals from the transmitting station, i.e., failure of the adjustment in the vertical direction of the receiving antenna.

SUMMARY OF THE INVENTION

An object of the invention is to provide a receiving antenna which makes the reception ratio optimum with the use of two joints which allow the receive angles of the receiving antenna to be adjusted in both horizontal and vertical directions so as to transmit and receive in a specified direction with a precise directivity.

Another object of the invention is to provide a compatible receiving antenna for both seated and standing modes.

The objects of the invention are accomplished by providing a sky wave receiving antenna which includes a receiving element having a radiator and a plurality of directors arranged in parallel on a horizontal support boom with a constant interval in a alternatively crossed direction, a base and a vertical direction adjustor rotationally connected at its one end to the base with a use of a first joint. The receiving antenna further includes a second joint connected to the other end of the vertical direction adjustor and connected to the receiving element so as to obtain a horizontal direction adjustment of the receiving element.

The receiving antenna of the invention allows the adjustment of the receiving element to be made in both vertical and horizontal directions in order to enhance the receive directivity.

DETAILED DESCRIPTION OF THE INVENTION

Figure 1:
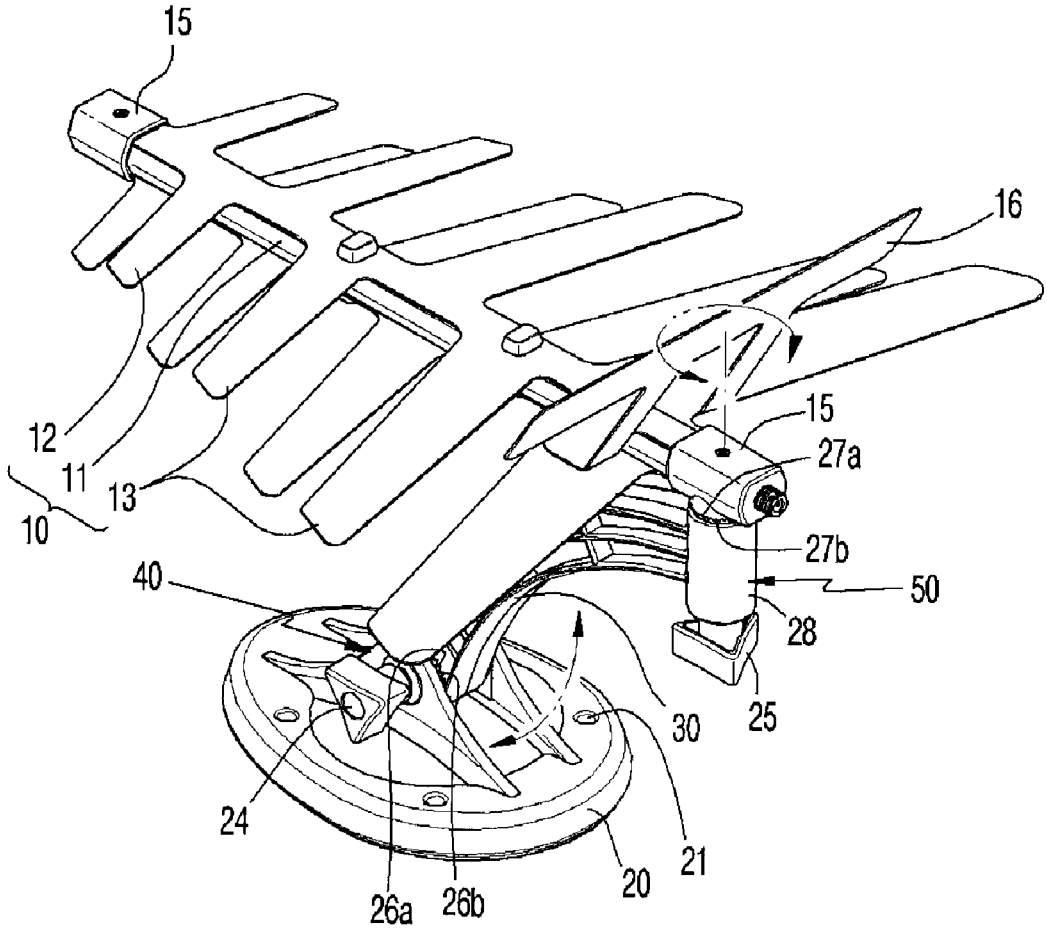
FIG. 1 is a perspective view illustrating a receiving antenna according to the present invention.

Referring to FIG. 1, a perspective view of an exemplary embodiment of the present invention for a receiving antenna is shown. The receiving antenna includes a receiving element 10, a base 20 and a vertical direction adjustor 30.

The receiving element 10 comprises a tubular horizontal support boom 11 with a given length and a radiator 12 and directors 13 which are made of a plate either sides of which partially cut off and arranged in parallel with a constant interval in an alternatively crossed manner with each other.

The base 20 is a general disk shape and allows the receiving antenna of the invention to be installed in such a manner whether the antenna is seated on a table or the like in a seated mode or mounted on a supporting structure in a standing or wall-mounted mode.

When the receiving antenna is employed in a seated mode, the base 20 carries a suitable weight for confronting with a biased weight caused from the upper portion of the antenna due to the length or weight of the receiving element 10 and for keeping the equilibrium of the antenna stable.

A vertical direction adjustor 30 extending with a minor arc is rotationally connected at its one end to the base 20 with the use of a first joint 40 so as to adjust the angle of the receiving element 10 in a vertical direction, i.e., to adjust the receive angle for the scanning direction of the signals from the transmitting station.

At the other end of the vertical direction adjustor 30, a second joint 50 is provided for adjusting the receive angle of the receiving element 10 in a horizontal direction which is across the vertical direction of the first joint 40.

Figure 2A:
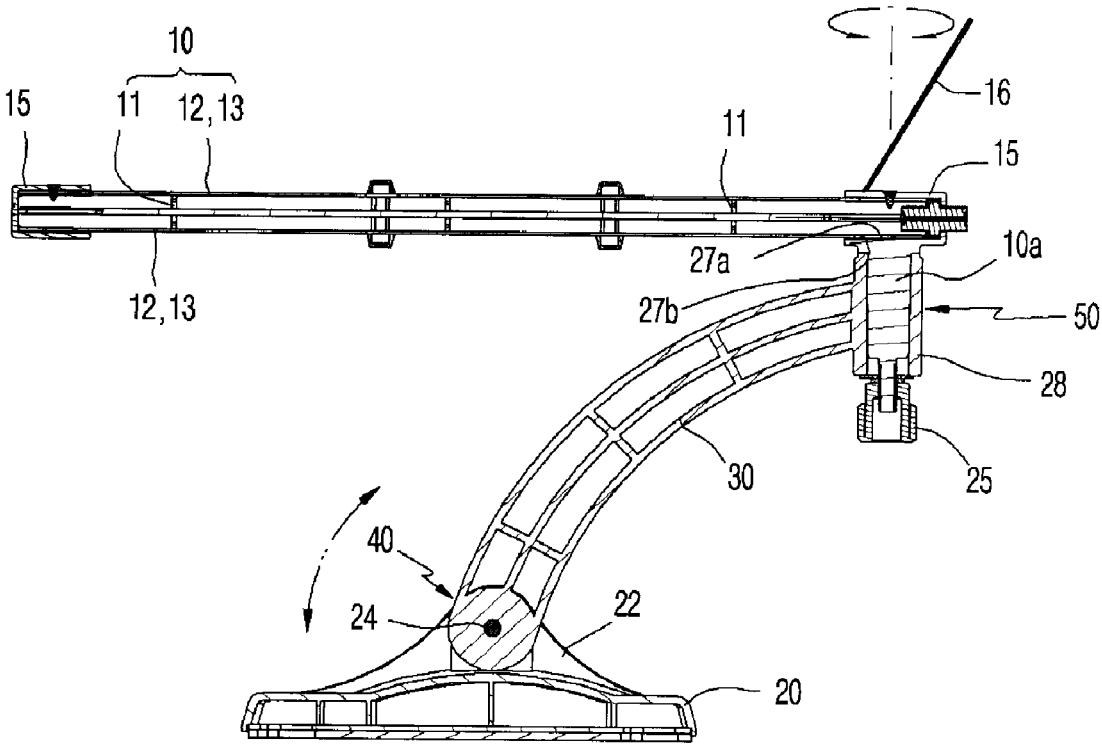
FIG. 2A is a front cross sectional view of a receiving antenna according to the present invention.
Figure 2B:
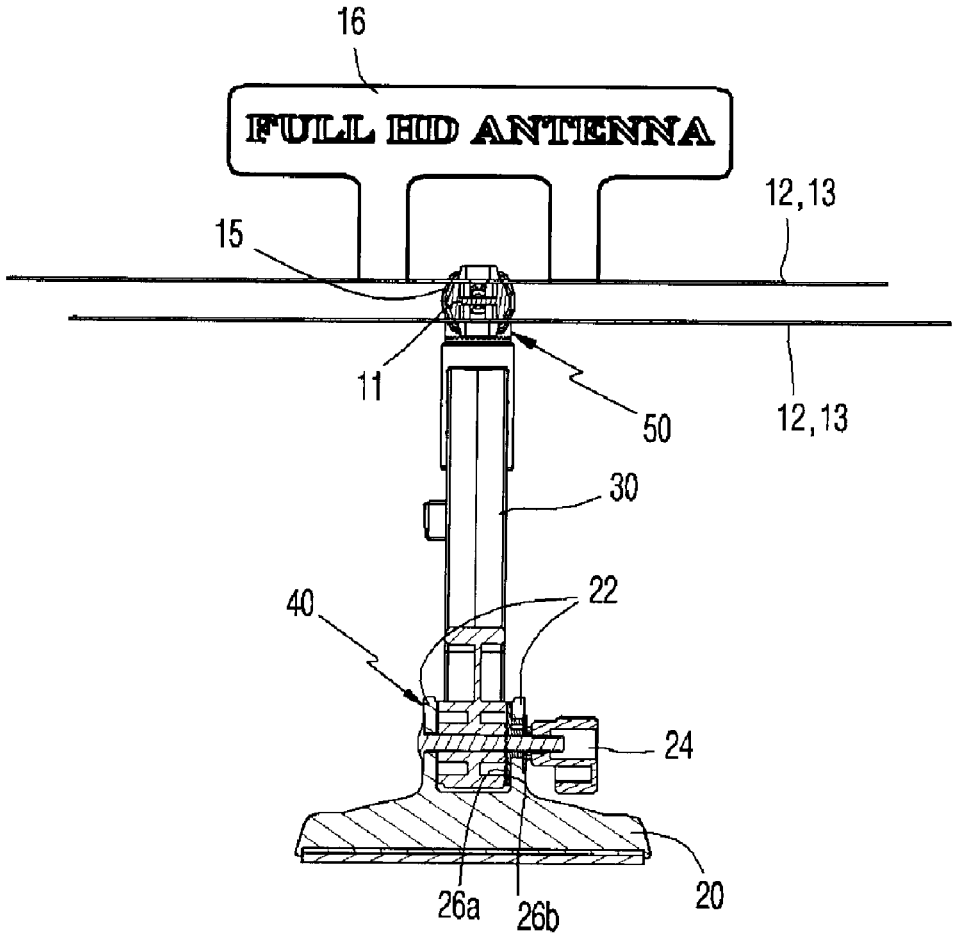
FIG. 2B is a side cross sectional view of the receiving antenna according to the present invention.

FIGS. 2A and 2B illustrate in detail the structure of the first and second joints 40 and 50. The first joint 40 includes the vertical direction adjustor 30 free rotationally connected at its one end to a pair of axial supports 22 installed on the base 20. The first joint 40 further includes an adjustment bolt 24 passing through the one end of the vertical direction adjustor 30 and engagement components 26*a* and 26*b* provided to the opposed surfaces of one of the axial supports 22 and the vertical direction adjustor 30, wherein the adjustment of rotational angle in a vertical direction of the vertical direction adjustor 30 is accomplished by coupling and decoupling the engagement components 26*a* and 26*b* in a state in which the adjustment bolt 24 is loosened or tightened.

Meanwhile, the second joint 50 includes an axial tube 28 which is connected to the other end of the vertical direction adjustor 30 in a vertical direction to the vertical direction adjustor 30 as shown in FIG. 2A, on one hand, and is free rotationally connected to the receiving element 10 at its one end 10*a*, on the other hand. The second joint 50 further includes an adjustment bolt 25 provided to a bottom end of the axial tube 28 and engagement components 27*a* and 27*b* provided to the opposed surfaces of the one end 10*a* of the receiving element 10 and the axial tube 28.

The adjustment of rotational angle in a horizontal direction of the receiving element 10 against the vertical adjustment of the vertical direction adjustor 30 is accomplished by coupling and decoupling the engagement components 27*a* and 27*b* in a state in which the adjustment bolt 25 is loosened or tightened.

In the receiving element 10, the radiator 12 and directors 13 placed on the upper and bottom surfaces of the horizontal support boom 11 are fixed to the support boom 11 employing coupling caps 15 each of which is assembled at either ends of the support boom 11. Furthermore, the receiving element 10 is provided with a carrier wave receiver 16.

Figure 3:
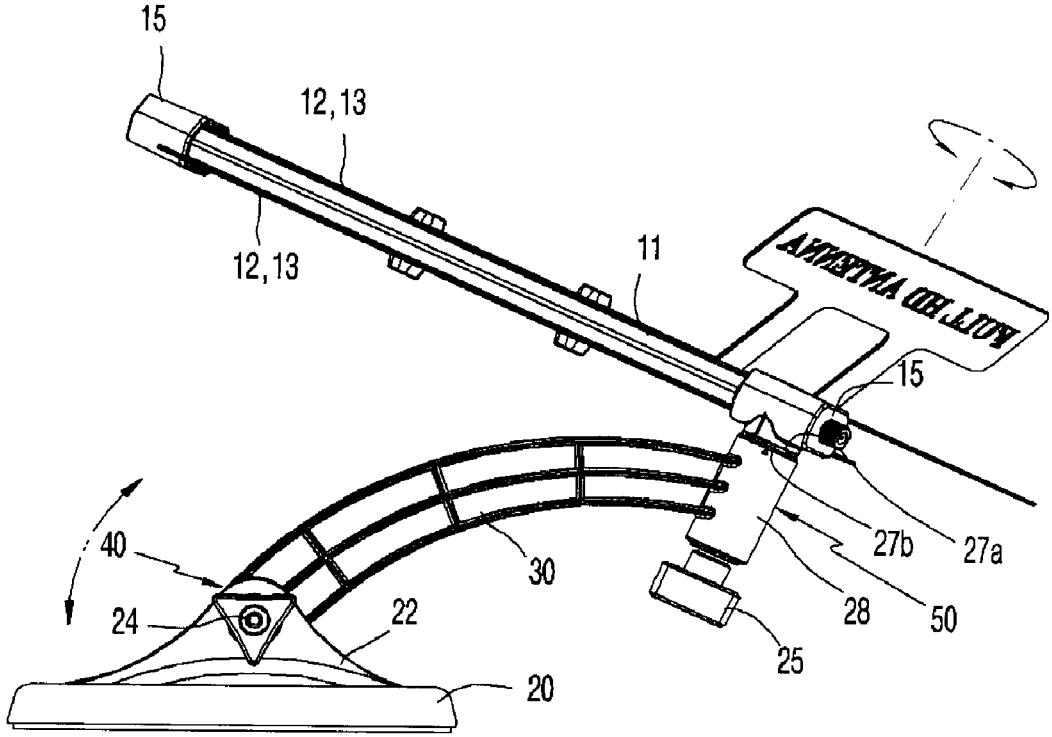
FIG. 3 shows how the angle of the receiving antenna of the present invention is adjusted in both vertical and horizontal directions.
Figure 4:
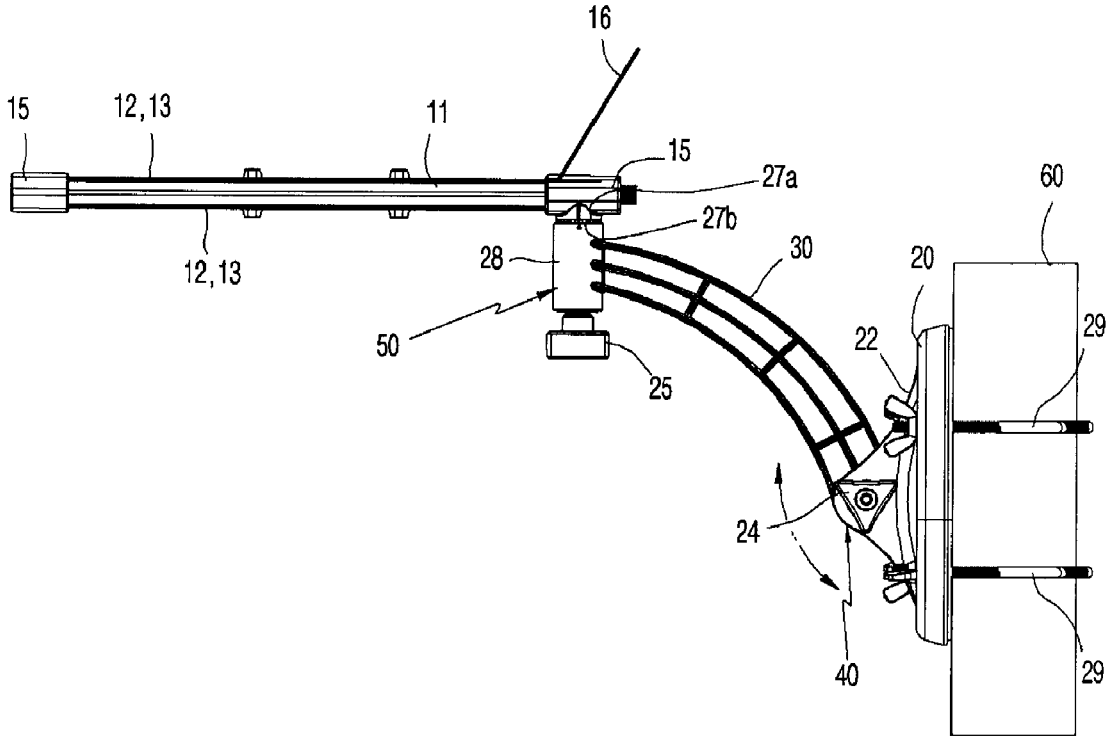
FIG. 4 shows another embodiment of the receiving antenna according to the present invention.

FIGS. 3 and 4 illustrate how the receiving antenna of the invention can be used in a seated manner or a standing manner. FIG. 3 shows the seated mode of the receiving antenna of the invention in which the receiving antenna is placed on a desk or pieces of other furniture in a horizontal direction to the plane of the drawings.

FIG. 4 illustrates the standing or wall-mounted mode of the receiving antenna of the invention in which the receiving antenna is installed on an indoor or outdoor supporting structure 60 such as a wall or pole in a vertical direction to the plane of the drawings. In this embodiment, the receiving antenna is installed on the supporting structure 60 with holes for assembly 21 and clamps 29.

With the receiving antenna having the above-mentioned configuration, since waves radiate from the radiator and direct to directors while are reflected by a reflector in a contrary position, efficient radiation is obtainable in a desired direction. The receiving antenna is widely used for receiving microwaves and television broadcasting signals and has gain variable with lengths, thicknesses, intervals and numbers of each element.

While the invention has been shown and described with reference to a certain preferred embodiment thereof, it will be understood by those skilled in the art that various changes in form and details may be made therein without departing the spirit and scope of the invention as recited by the appended claims.

What is claimed is:

1. A receiving antenna comprising:

a base;

a receiving element having a horizontal support boom, a radiator and directors, the radiator and directors being placed on the support boom with a constant interval;

a vertical direction adjustor rotationally connected at its one end to the base with a use of a first joint so as to adjust the receiving element in a vertical direction; and a second joint connected to the other end of the vertical direction adjustor and connected to the receiving element so as to obtain a horizontal direction adjustment of the receiving element.

2. The receiving antenna of claim 1, wherein each of the first and second joints comprises an adjusting means for adjusting the receiving element.

3. The receiving antenna of claim 1, wherein the receiving element comprises coupling caps for fixing both ends of the radiator and directors to the support boom.

4. The receiving antenna of claim 1, wherein the base is placed on a desk or the like so as to employ the receiving antenna in a seated mode.

5. The receiving antenna of claim 1, wherein the base is installed on a supporting structure so as to employ the receiving antenna in a wall-mounted mode.

* * * * *